US007413462B2

(12) United States Patent
Cheng et al.

(10) Patent No.: US 7,413,462 B2
(45) Date of Patent: Aug. 19, 2008

(54) APPLIANCE SHELL WITH A PLUG-RECEIVING ASSEMBLY

(75) Inventors: Hsiung-Kuei Cheng, Taipei (TW); Jian-Hung Chen, Taipei (TW); Yuan-Liang Hsu, Taipei (TW); Lien-Hsun Ho, Taipei (TW)

(73) Assignee: Cyber Power System Inc., Taipei (TW)

( * ) Notice: Subject to any disclaimer, the term of this patent is extended or adjusted under 35 U.S.C. 154(b) by 0 days.

(21) Appl. No.: 11/451,017

(22) Filed: Jun. 12, 2006

(65) Prior Publication Data

US 2007/0287321 A1 Dec. 13, 2007

(51) Int. Cl.
*H01R 13/64* (2006.01)

(52) U.S. Cl. ..... 439/374

(58) Field of Classification Search ..... 439/372–374, 439/297, 296, 133, 134, 369
See application file for complete search history.

(56) References Cited

U.S. PATENT DOCUMENTS 4,592,764 A * 6/1986 Ikezaki et al. ..... 96/382
6,056,580 A * 5/2000 Cross et al. ..... 439/369
6,059,081 A * 5/2000 Patterson et al. ..... 191/12.2 R
7,195,512 B2 * 3/2007 Jenkinson et al. ..... 439/372

FOREIGN PATENT DOCUMENTS

JP 001162702 A2 * 12/2001

* cited by examiner

*Primary Examiner*—Alexander Gilman
(74) *Attorney, Agent, or Firm*—Alan Kamrath; Kamrath & Associates PA

(57) ABSTRACT

A shell for an electrical appliance includes a base, a cover, and a plug-receiving assembly. The plug-receiving assembly includes a recess attached to the cover for receiving a plug of the electrical appliance. The recess has a bottom and two opposing sides. The bottom supports the plug, and the opposing sides have protrusions for retaining the plug in the recess. The plug-receiving assembly further includes a slanted guide formed on the bottom of the recess for guiding the plug in the recess. A user may remove the plug from the recess by the pulling an electrical wire attached to the plug to move the plug along the slanted guide and out from the recess. Additionally, the plug-receiving assembly may include a mounting grove adjacent to the slanted guide for retaining the electrical wire.

14 Claims, 6 Drawing Sheets

APPLIANCE SHELL WITH A PLUG-RECEIVING ASSEMBLY

BACKGROUND OF THE INVENTION

1. Field of Invention

The present invention relates to a shell for an electrical appliance and more particularly to a shell with an assembly for mounting a plug of the electrical appliance.

2. Description of the Related Art

An electrical appliance typically has a shell covering components of the electrical appliance. The shell includes an opening for an electrical wire, which can electrically connect with the electrical appliance to an electrical device, such as a power source. A plug attached to the electrical wire is connected with a socket of the electrical device to establish an electrical connection between the electrical appliance and the electrical device. Once the electrical connection is established, the electrical appliance and the electrical device can transmit electrical signals to each other through the electrical wire.

The plug may be disconnected from the socket when the electrical appliance does not need to communicate with the electrical device. For example, the plug is disconnected from the socket when the electrical appliance or the electrical device is not in use. When the plug is disconnected from the socket, the electrical wire may become entangled, which can make it difficult for a user to locate the plug.

To overcome the shortcomings, the present invention provides a shell with plug-receiving assembly to mitigate or obviate the aforementioned.

SUMMARY OF THE INVENTION

The primary objective of the present invention is to provide a shell with an assembly for mounting a plug of an electrical appliance.

To achieve the objective, a shell includes a plug-receiving assembly for mounting an electrical wire and a plug of an electrical appliance. The plug-receiving assembly includes a recess that protrudes into an interior of the shell to retain the plug. The recess includes a slanted guide for guiding the plug in the recess. Additionally the plug-receiving assembly includes a mounting groove to retain the electrical wire. A user can remove the plug from the plug-receiving assembly by pulling the electrical wire to remove the electrical wire from the mounting groove and to move the plug along the slanted guide and out of the recess.

Other objectives, advantages and novel features of the invention will become more apparent from the following detailed description when taken in conjunction with the accompanying drawings.

BRIEF DESCRIPTION OF THE DRAWINGS

Accompanying drawings are included to provide a further understanding of the invention and are incorporated in and constitute a part of this specification. The drawings illustrate embodiments of the invention and together with the description, serve to explain the principles of the invention. In the drawings.

DETAILED DESCRIPTION OF THE INVENTION

Figure 1:
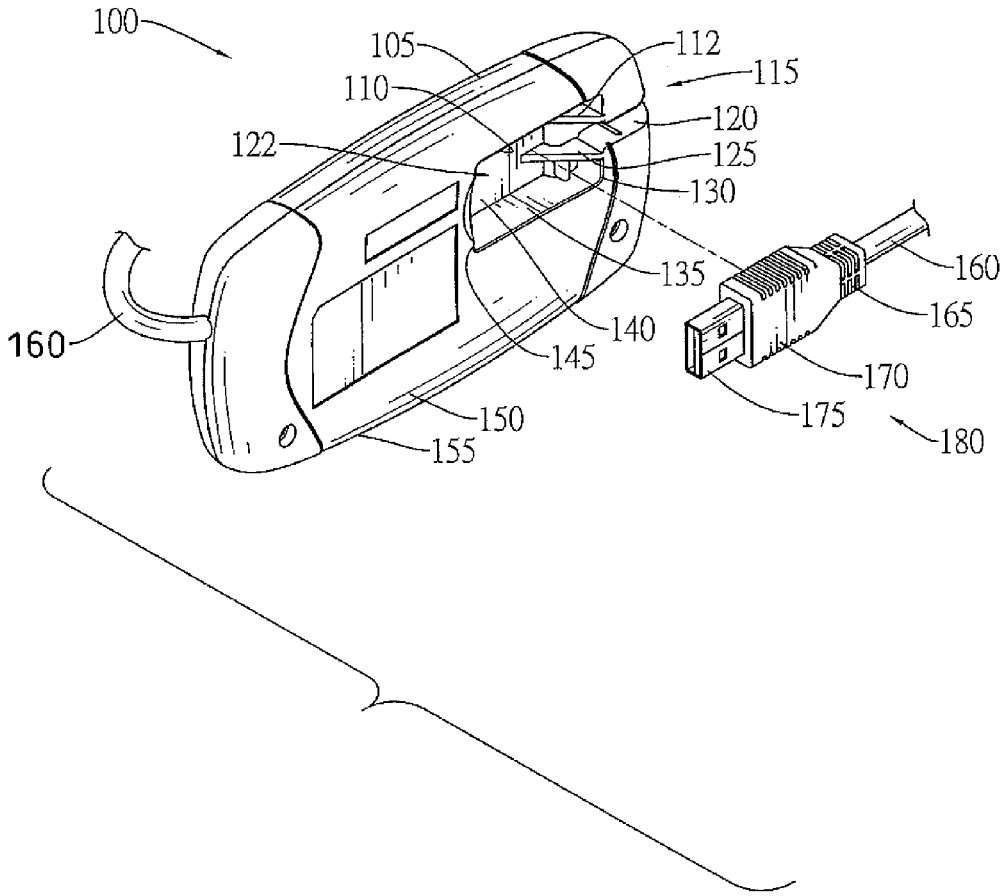
FIG. 1 is a perspective view of a shell in accordance with the present invention along with a plug and an electrical wire of an electrical appliance.

FIG. 1 illustrates a shell 100, in accordance with the present invention, along with an electrical wire 160 and a plug 180 of an electrical appliance. The shell 100 surrounds the electrical appliance and the electrical wire 160 passes through an opening of the shell 100. The plug 180 is attached to the electrical wire 160 and includes a portion 170 between a narrow portion 165 and a connector 175. The narrow portion 165 is adjacent to the electrical wire 160. The connector 175 is electrically connected to the electrical wire 160 through the plug 180. The connector 175 can be any type of connector for electrically connecting the electrical appliance to an electrical device or circuit. For example, the connector 175 may be a Universal Serial Bus (USB) connector.

The shell 100 further includes a cover 155, a base 105 and a plug-receiving assembly 115. The cover 155 is mounted with the base 105 and the plug-receiving assembly 115 is attached to the cover 155. The plug-receiving assembly 115 includes a recess 122 configured to receive the plug 180. The recess 122 may be substantially shaped like the plug 180 and the recess 122 may be substantially rectangular-shaped. The recess 122 includes a first end 130, a second end 145, a bottom 140, a first side 110 and a second side 135 opposing the first side 110. The first side 110 and the second side 135 are each attached to the bottom 140, the first end 130, the second end 145 and the cover 155. The bottom 140 supports the plug 180 when the plug 180 is in the recess 122. The sides 110 and 135 each extend longitudinally between the ends 130 and 145. The recess may be formed in an outer surface 150 of the cover 155.

The plug-receiving assembly 115 further includes a slanted guide 125 formed on the bottom 140 of the recess 122. The slanted guide 125 includes at least one edge 112 that extends from the outer surface 150 of the cover 155 at the end 130 of the recess 122 downwardly tote bottom 140 of the recess 122 in a direction toward the second end 145 of the recess 122. The slanted guide 125 guides the plug 180 away from the second end 145 of the recess 122 and out of the recess 122 when the plug 180 is removed from the recess 122.

The plug-receiving assembly 115 may also include a mounting groove 120 formed on the outer surface 150 of the cover 155. The mounting groove 120 is adjacent to the slanted groove 125 and extends from the end 130 of the recess 122 away from the recess 122. The mounting groove 120 is configured to retain the electrical wire 160. For example, the electrical wire 160 can be tightly mounted in the mounting groove 120 by inserting the electrical wire 160 into the mounting groove 120.

Figure 2:
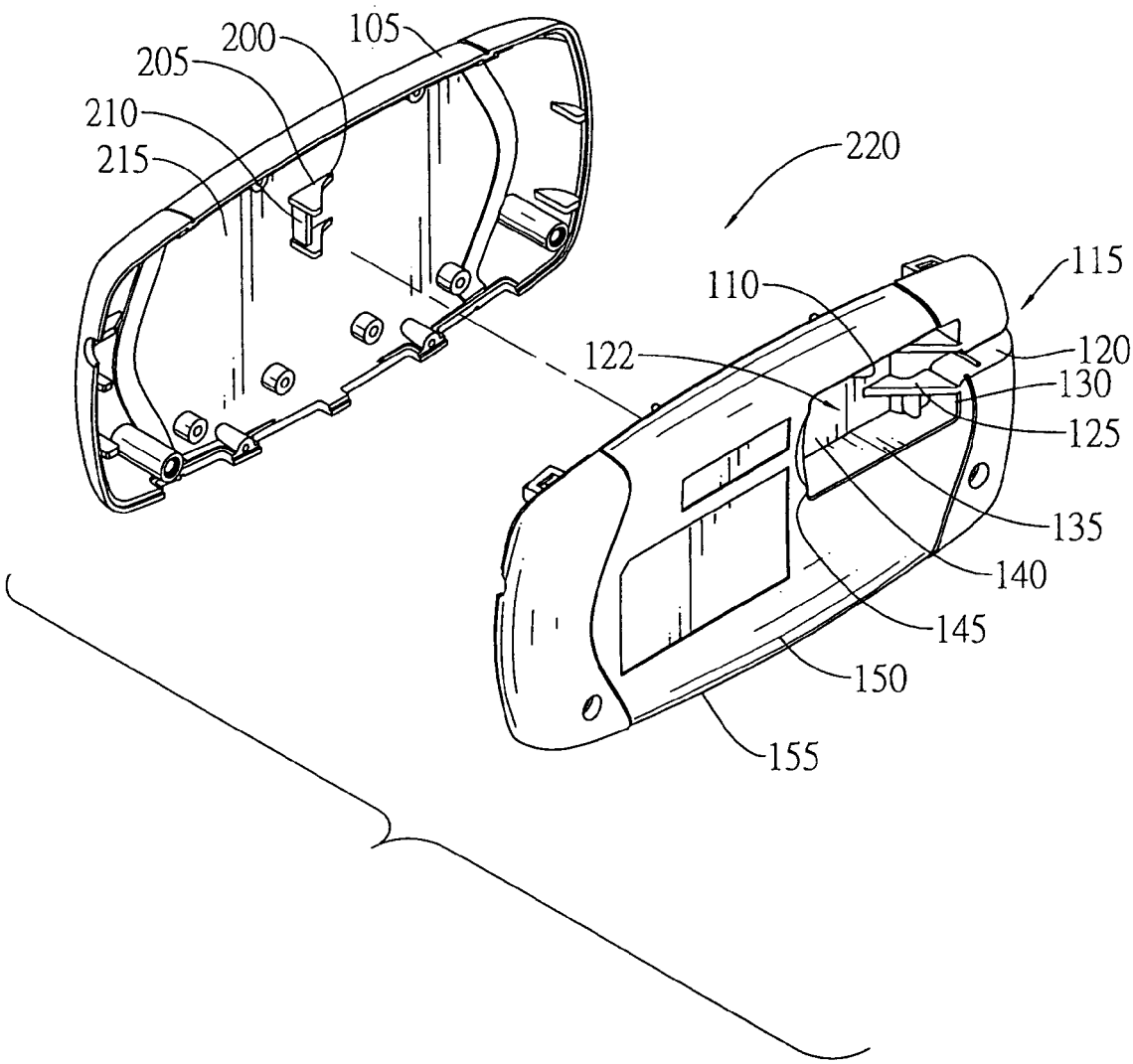
FIG. 2 is an exploded perspective view of a shell in FIG. 1.

With reference to FIG. 2, the cover 155 and the base 105 together surround an interior 220 of the shell 100 when the cover 155 is mounted with the base 105. Moreover, the recess 122 protrudes into the interior 220 of the shell 100. The base 105 includes a guiding device 210 formed on an inner surface 215 of the base 105. The guiding device 210 protrudes into the interior 220 of the shell 100 when the cover 155 is mounted with the base 105 and guides the connector 175 (FIG. 1) in the recess 122 when the plug 180 (FIG. 1) is inserted into the recess 122.

In one embodiment, the guiding device 210 includes one or more tabs 205 extending from the inner surface 215 of the base 105. The tab 205 of the guiding device 210 includes a curved edge 200 for contacting the connector 175 (FIG. 1) of the plug 180 (FIG. 1) and guiding the connector 175 toward the second end 145 of the recess 122 when the plug 180 is inserted into the recess 122. Additionally, the curved edge 200 of the tab 205 is used to guide the connector 175 away from the second end 145 of the recess 122 when the plug 180 is removed from the recess 122. The tabs 205 may be a pair of substantially parallel tabs. The guiding device 210 may include more or fewer tabs 205.

Figure 3:
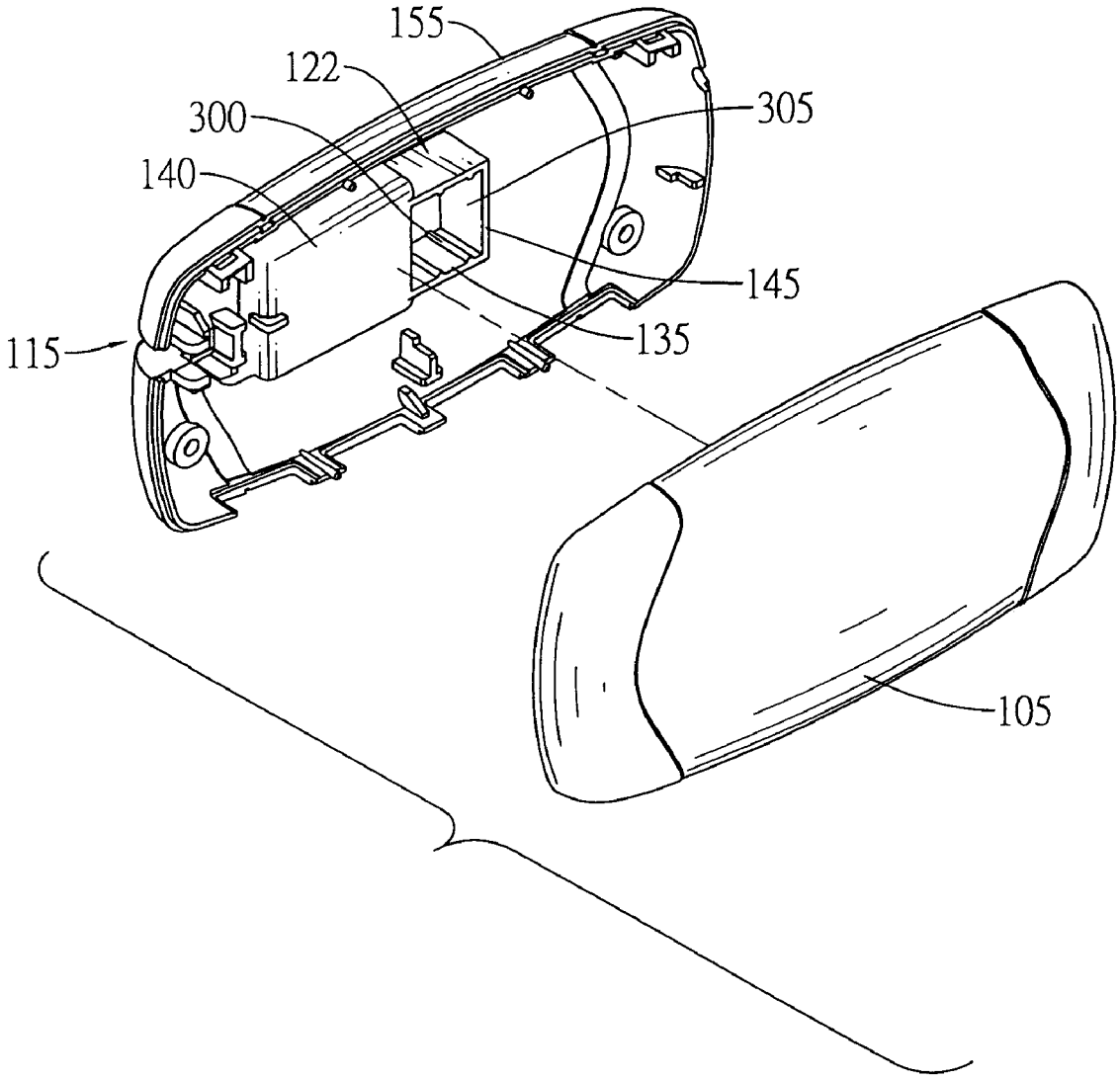
FIG. 3 is another exploded perspective view of a shell in FIG. 1.

With reference to FIG. 3, the recess 122 includes an opening 305 in the bottom 140 at the second end 145. The opening 305 allows the guiding device 210 (FIG. 2) to protrude into the recess 122 when the cover 155 is mounted with the base 105. Additionally, the side 135 of the recess 122 includes protrusions 300 for engaging the connector 175 (FIG. 1) in the recess 122. The protrusions 300 may be elongated parallel strips that extend laterally along the side 135. Although two protrusions 300 are shown in FIG. 3, the side 135 may have more or fewer protrusions 300.

As may be envisioned from FIG. 3, the side 110 (FIG. 1) also has one or more protrusions 300 for engaging the connector 175 (FIG. 1). The protrusions 300 on the sides 110 and 135 are configured to retain the plug 180 (FIG. 1) in the recess 122 by engaging the connector 175 in the recess 122. For example, protrusions 300 on the opposing sides 110 and 135 can be configured to increase friction between the connector 175 and the protrusions 300 when the connector 175 is between the protrusions 300.

Figure 4:
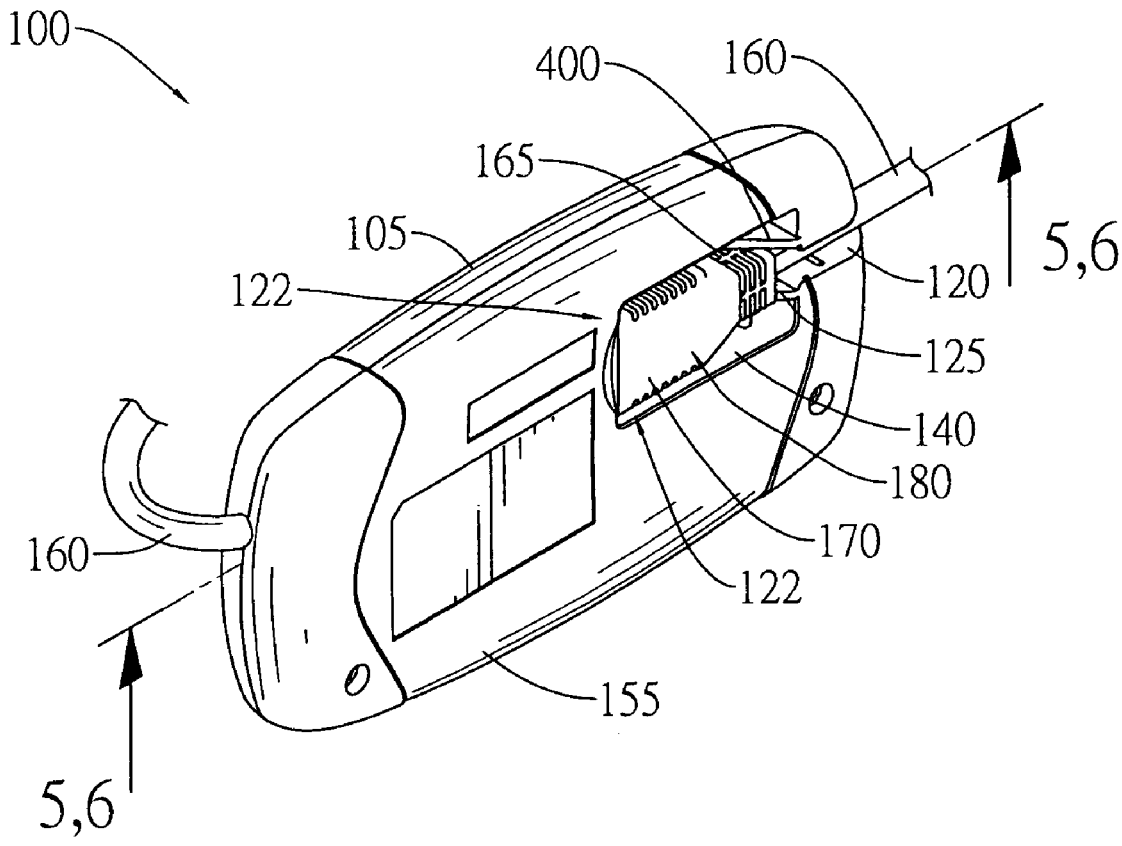
FIG. 4 is a perspective view of a shell in FIG. 1 along with the plug and the electrical wire of the electrical appliance mounted in a plug-receiving assembly of the shell.

With reference to FIG. 4, the plug 180 is mounted in the recess 122 and the electrical wire 160 is mounted in the mounting groove 120. In this way, the plug 180 and the electrical wire 160 are mounted in the plug-receiving assembly 115 (FIG. 1). Moreover, the plug-receiving assembly 115 retains the plug 180 and the electrical wire 160. The slanted guide 125 may include a pair of parallel tabs 400 configured to receive the narrow portion 165 of the plug 180 between the tabs 400. The parallel tabs 400 guide the portion 170 of the plug 180 when the plug 180 is removed from the recess 122.

Figure 5:
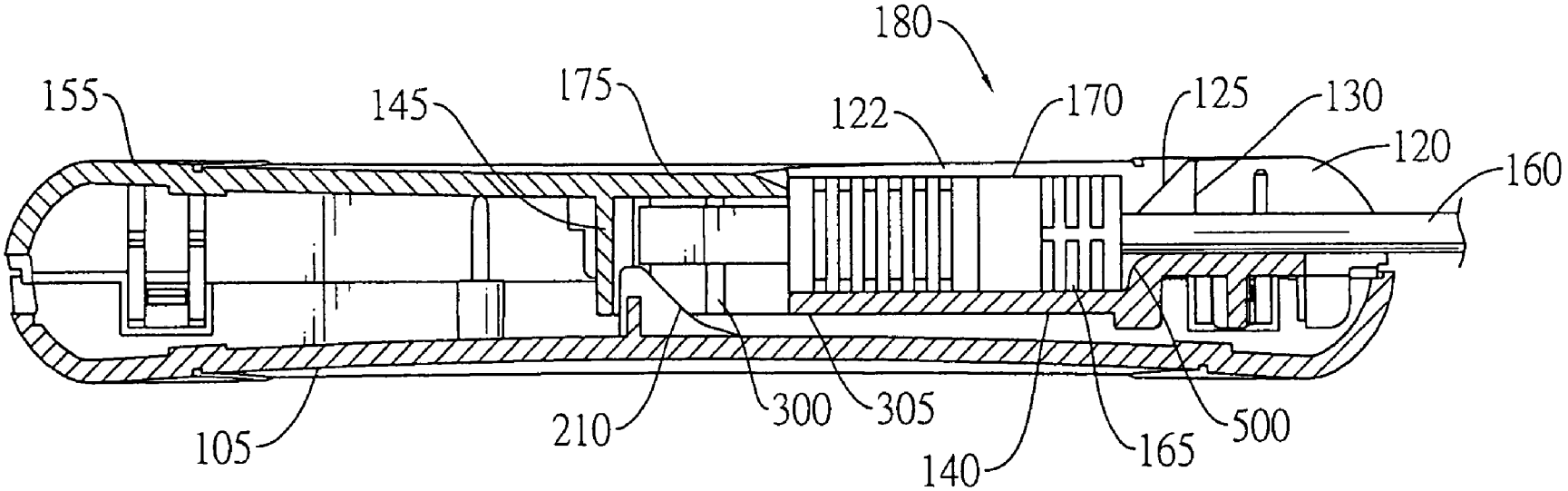
FIG. 5 is a cross-sectional view of the shell in FIG. 4 along the line 5-5.

With reference to FIG. 5, the plug 180 is mounted in the recess 122 and the electrical wire 160 is mounted in the mounting groove 120. The plug 180 is juxtaposed with the bottom 140 of the recess 122. The connector 175 is in contact with the protrusion 300 and the guiding device 210 at the second end 145 of the recess 122. The recess 122 may include a flange 500 extending outward from the bottom 140 of the recess 122 at the end 130. As illustrated, the narrow portion 165 of the plug 180 abuts the flange 500 when the plug 180 is mounted in the recess 122. The flange 500 has a curved surface to guide the plug 180 when the plug 180 is removed from the recess 122.

Figure 6:
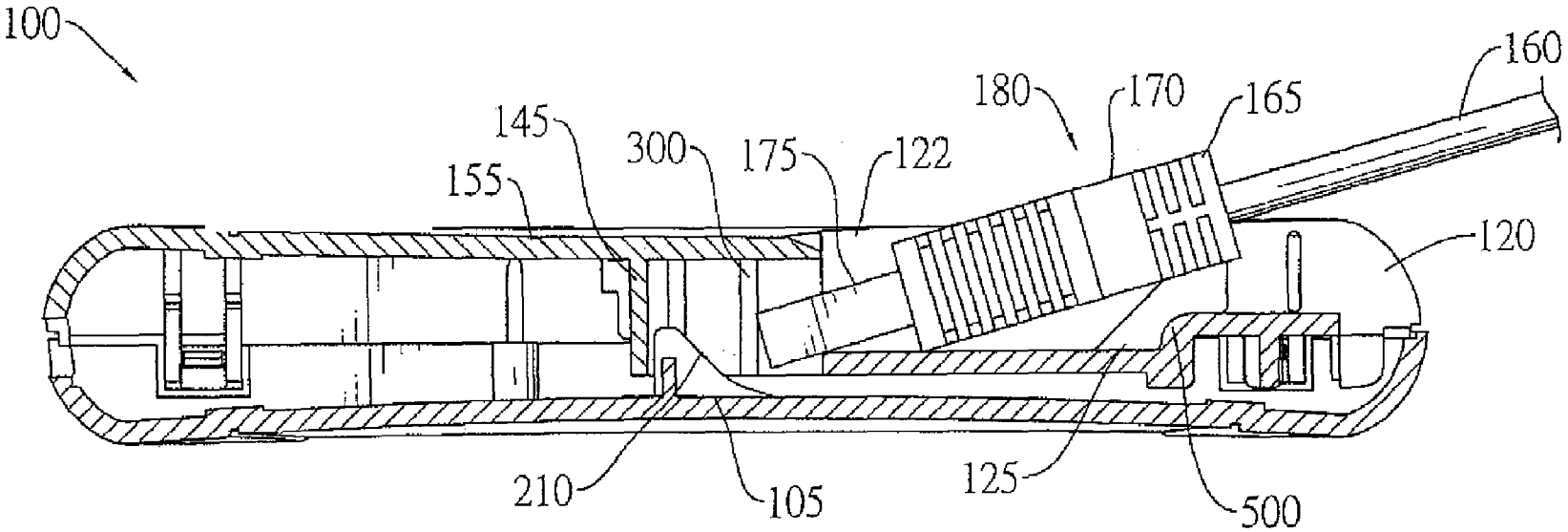
FIG. 6 is a cross-sectional view of the shell in FIG. 4 along the line 6-6, in which the plug is partially in the plug-receiving assembly.

With reference to FIG. 6 illustrates a cross-section view of the shell 100 taken along the line 6-6 of FIG. 4 showing the plug 180 partially in the recess 122. As may be envisioned from FIGS. 5 and 6, a user can pull the electrical wire 160 to disengage the connector 175 from the protrusions 300 and to move the plug 180 away from the second end 145 of the second recess 122. As the electrical wire 160 is pulled, the portion 170 of the plug 180 contacts the slanted guide 125 and the slanted guide 125 guides the plug 180 out from the recess 122. In this way, the plug 180 is removed from the recess 122 by pulling the electrical wire 160. Moreover, the guiding device 210 may guide the connector 175 away from the second end 145 when the plug 180 is removed from the recess 122. In some embodiments, the plug 180 does not have the narrow portion 165. Moreover, the portion 170 is adjacent to the electrical wire 160 and the slanted guide 125 guides the portion 170 of the plug 180 when the plug 180 is removed from the recess 122.

The shell includes the plug-receiving assembly for mounting the electrical wire and the plug of the electrical appliance. The plug-receiving assembly includes the recess that protrudes into the interior of the shell to retain the plug. The recess includes the slanted guide for guiding the plug in the recess. Additionally the plug-receiving assembly includes a mounting groove to retain the electrical wire. A user can remove the plug from the plug-receiving assembly by pulling the electrical wire to remove the electrical wire from the mounting groove and to move the plug along the slanted guide and out of the recess.

Although the invention has been described with reference to particular embodiments thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A shell for an electrical appliance comprising:

a cover comprising an outer surface;

an assembly adapted for receiving a plug and comprising:

a recess formed in the outer surface of the cover and comprising:

a bottom, a first end, a second end, a first side; and a second side opposing the first side;

at least one protrusion formed on each of the first side and the second side for retaining the plug in the recess; and a slanted guide formed on the bottom of the recess at the first end adapted for guiding the plug in the recess and extending from the first end downwardly to the bottom of the recess, wherein the cover further comprises a mounting groove mounted in the outer surface of the cover, adjacent to the slanted guide and extending from the first end away from the recess to be adapted for retaining an electrical wire attached to the plug, wherein the slanted guide comprises a pair of substantially parallel guiding tabs.

2. The shell as claimed in claim 1, wherein the recess is substantially rectangular-shaped.

3. The shell as claimed in claim 1, wherein the first side is substantially parallel to the second side.

4. The shell as claimed in claim 1 further comprising a base mounted with the cover and the base and the cover combined to cover an interior of the shell.

5. The shell as claimed in claim 4, wherein the bottom of the recess comprises an opening at the second end of the recess; and the base comprises:

an inner surface; and a guiding device formed on the inner surface of the base, protruding into the recess through the opening in the bottom for guiding the plug in the recess.

6. The shell as claimed in claim 5, wherein the plug comprises a connector; and the guiding device comprises a pair of substantially parallel tabs extending away from the inner surface of the base into the recess and each tab of guiding device having a curved edge for guiding the connector in the recess.

7. The shell as claimed in claim 1, with the first side extending longitudinally between the first end and the second end; and with the second side extending longitudinally between the first end and the second end.

8. The shell as claimed in claim 7, wherein the plug comprises a connector; and the protrusions on the first side and the second side are configured to engage the connector for retaining the plug in the recess.

9. The shell as claimed in claim 7, wherein the at least one protrusion on the first side is an elongated strip extending laterally along the first side; and the at least one protrusion on the second side is an elongated strip extending laterally along the second side.

10. A shell for an electrical appliance having an electrical wire attached to a plug, the shell comprising:

a cover comprising:

an outer surface; and a recess formed in the outer surface and comprising:

a bottom;

a first end;

a second end;

a first side; and a second side opposing the first side and the second side and the first side being substantially parallel and each extending longitudinally between the first end and the second end;

a protrusion formed on each of the first side and the second side for retaining the plug in the recess;

a mounting groove mounted in the outer surface of the cover adapted for retaining the electrical wire and extending from the first end away from the recess;

a slanted guide formed on the bottom of the recess, adjacent to the mounting groove for guiding the plug in the recess, extending from the outer surface of the cover downwardly to the bottom of the recess in a direction toward the second end of the recess; and a base mounted with the cover to surround an interior of the shell and comprising an inner surface, wherein the bottom of the recess comprises an opening at the second end of the recess; and the base further comprises a guiding device formed on the inner surface of the base adapted for guiding the plug in the recess and the guiding device configured to protrude through the opening into the recess when the cover is mounted with the base.

11. The shell as claimed in claim 10, wherein the protrusion on the first side is an elongated strip extending laterally along the first side; and the protrusion on the second side is an elongated strip extending laterally along the second side.

12. The shell as claimed in claim 10, wherein the slanted guide is configured to guide the plug out of the recess when the electrical wire is pulled away from the recess.

13. The shell as claimed in claim 10, wherein the plug comprises a connector; and the guiding device comprises a pair of substantially parallel guiding tabs extending away from the inner surface of the base and each guiding tab of the guiding device having a curved edge for contacting the connector.

14. The shell as claimed in claim 13, wherein the slanted guide comprises a pair of substantially parallel guiding tabs.

* * * * *